US007147201B2

(12) United States Patent
Grimmer et al.

(10) Patent No.: US 7,147,201 B2
(45) Date of Patent: Dec. 12, 2006

(54) METHOD FOR ANNEALING AN ELECTRODEPOSITION STRUCTURE

(75) Inventors: Robert Grimmer, Berwick, ME (US); Alex Risca, Troy, MI (US); Richard Combs, Farmington, NH (US)

(73) Assignee: Collins & Aikman, Southfield, MI (US)

( * ) Notice: Subject to any disclaimer, the term of this patent is extended or adjusted under 35 U.S.C. 154(b) by 32 days.

(21) Appl. No.: 10/952,649

(22) Filed: Sep. 29, 2004

(65) Prior Publication Data

US 2005/0127267 A1 Jun. 16, 2005

Related U.S. Application Data

(62) Division of application No. 10/099,915, filed on Mar. 15, 2002, now Pat. No. 6,814,915.

(51) Int. Cl.
*C25D 1/10* (2006.01)
*C21D 1/26* (2006.01)

(52) U.S. Cl. ..... 249/135; 148/516; 148/675; 205/70

(58) Field of Classification Search ..... 249/135; 148/516, 675; 205/70
See application file for complete search history.

(56) References Cited

U.S. PATENT DOCUMENTS

| | | | | |
|---|---|---|---|---|
| 4,023,966 | A | 5/1977 | Loersch et al. | 75/226 |
| 4,108,740 | A | 8/1978 | Wearmouth | 204/11 |
| 4,389,177 | A | 6/1983 | Colby | 425/144 |
| 4,522,659 | A | 6/1985 | Prusak | 148/526 |
| 4,562,026 | A | 12/1985 | Mosher | 264/135 |
| 4,564,501 | A | 1/1986 | Goldstein | 419/25 |
| 4,610,620 | A | 9/1986 | Gray | 425/434 |
| 4,623,503 | A | 11/1986 | Anestis et al. | 264/302 |
| 4,755,333 | A | 7/1988 | Gray | 264/37 |
| 4,780,345 | A | 10/1988 | Gray | 428/35 |
| 4,890,995 | A | 1/1990 | Gray | 425/144 |
| 4,923,657 | A | 5/1990 | Gembinski et al. | 264/73 |
| 4,925,151 | A | 5/1990 | Gray | 249/65 |
| 5,032,076 | A | 7/1991 | Jackson, Jr. | 425/435 |
| 5,037,678 | A | 8/1991 | Kinkelaar | 427/388.1 |
| 5,238,622 | A | 8/1993 | Grimmer | 264/45.5 |
| 5,290,499 | A | 3/1994 | Tischler | 264/301 |
| 5,445,510 | A | 8/1995 | Jackson, Jr. | 425/182 |
| 5,470,651 | A | 11/1995 | Milinkovic et al. | 428/325 |
| 5,824,738 | A | 10/1998 | Humphrey et al. | 524/715 |
| 5,998,030 | A | 12/1999 | Grimmer | 428/402 |
| 6,692,680 | B1 * | 2/2004 | Lee et al. | 264/485 |
| 2004/0128016 | A1 * | 7/2004 | Stewart | 700/159 |

* cited by examiner

*Primary Examiner*—Donald Heckenberg
(74) *Attorney, Agent, or Firm*—Grossman, Tucker, Perreault & Pfleger, PLLC

(57) ABSTRACT

A method for annealing a structure formed by electrodeposition is provided, the method comprising providing the electrodeposition structure, the electrodeposition structure comprising an electroformed mold, the electroformed mold having a nominal thickness between and including 0.5 mm to 8.0 mm and having a melting temperature; heating the electrodeposition structure to a temperature between ambient temperature and the melting temperature of the electrodeposition structure; isostatically pressurizing the electrodeposition structure to a pressure above ambient pressure; cooling the electrodeposition structure to ambient temperature; and depressurizing the electrodeposition structure to ambient pressure.

3 Claims, 5 Drawing Sheets

10% Sulfuric Acid Etch 100X
As-deposited microstructure

10% Sulfuric Acid Etch 100X
Annealed microstructure

10% Sulfuric Acid Etch 100X
Annealed microstructure

METHOD FOR ANNEALING AN ELECTRODEPOSITION STRUCTURE

CROSS REFERENCE TO RELATED APPLICATIONS

This application is a divisional of U.S. application Ser. No. 10/099,915, filed Mar. 15, 2002, now U.S. Pat. No. 6,814,915.

FIELD OF THE INVENTION

This invention relates to a method for annealing electrodeposition structures formed by electrodeposition techniques particularly suitable for use in electroforming.

BACKGROUND OF THE INVENTION

U.S. Pat. No. 4,623,503 to Anestis et al. entitled "Slush Molding Method With Selective Heating of Mold By Air Jets", assigned to the assignee of the present invention and hereby incorporated by reference, discloses a method of slush molding with the use of an electroformed nickel mold.

According to U.S. Pat. No. 4,108,740 to Wearmouth entitled "Hard, Heat-Resistant Nickel Electrodeposits", the production of electroforms involves building up deposits of adequate thickness on a mandrel without internal stress in the deposit so high as to cause premature separation of the deposit from the mandrel. The '740 patent goes on to state that the electroformability and hardness of nickel can be improved by electrodepositing the nickel from an electrolyte containing addition agents which introduce sulfur into the resulting electrodeposit and that, while sulfur improves electroformability by reducing the internal stress in the electrodeposit, it does so at the expense of ductility. In the '740 patent, for example, it is reported that sulfur contents in excess of approximately 0.005% cause the electrodeposit to embrittle upon exposure to temperatures above about 200 degrees Celsius, and that embrittlement at temperatures above ambient is particularly disadvantageous in electroforms requiring exposure to elevated temperatures, in applications such as molds and dies, or in fabrication such as screen printing cylinders which can be subjected to localized heating by brazing, welding or by the use of heat curable glues, or during surface masking using heat curable lacquers.

According to U.S. Pat. No. 5,470,651 to Milinkovic et al. entitled "Mandrel For Use in Nickel Vapor Deposition Processes And Nickel Molds Made Therefrom" one drawback of electroformed nickel shells and molds, in consequence of the fact that electroformed nickel contains relatively large amounts of sulpher, is that repairs or modifications to the shell or mold by means of welding cannot be preformed readily.

In addition to the above drawbacks, the Applicant has found that electrodeposition structures, such as the electroformed molds discussed above, may contain voids within the electrodeposition structure itself. These voids are formed during the build-up of deposits on the mandrel and are ordinarily of microscopic size, generally round in shape and on the magnitude of less than 0.005" in size.

Applicant has also found that, during heating of the electrodeposition structure, these voids, depending on their proximity to the surface of the electrodeposition structure, may cause the surface of the electrodeposition structure to distort in the form of a protuberance, similar to that of a bulge or bump, on the electrodeposition surface. Without being bound to a particular theory, the Applicant believes that heating of the electrodeposition structure causes pressure from gas, believed to comprise hydrogen generated and entrained during formation of the electrodeposition structure, within the void to increase. As a result, particularly in those areas of the electrodeposition structure where the voids are nearest the surface, the increase in gas pressure within the void overcomes the bending strength of the thin electrodeposition thickness above the void and forces the surface of the electrodeposition structure to rise.

In those instances where the voids produce surface protuberances, the Applicant has found that the voids may be repaired via welding. However, more problematic is whether the texture of the surface of the weld and surrounding electrodeposition structure are uniform and blended as to completely hide the presence of the repair. Applicant has found that the ability to repair the surface of the weld and surrounding electrodeposition structure adequately depends largely on the texture of the surface of the electrodeposition structure. Many of the electroformed molds used in the automotive industry have a grain texture formed on the electrodeposition surface. In some instances the texture of the electrodeposition surface can be repaired, while in other instances it cannot be successfully repaired as the grain pattern cannot be replicated in the repaired area. Thus, at the very least, voids in the electrodeposition structure result in costly repairs and time and, on occasion, the complete electrodeposition structure becomes scrap.

Furthermore, Applicant believes that while certain of the voids contained within the electrodeposition structure may not produce protuberances on the surface of the electrodeposition structure in response to heating of the structure, nevertheless Applicant believes these voids may weaken the overall electrodeposition structure resulting in premature cracks, metal fatigue, etc. of the electrodeposition structure.

What is needed is a process to anneal an electrodeposition structure to make the structure more ductile so as make the structure more receptive to repairs or modifications by means of welding. What is also needed is a process to anneal the electrodeposition structure such that the likelihood of voids which may be formed in the structure, giving rise to protuberances on the surface of the structure during heating, is reduced and more preferably eliminated.

SUMMARY OF THE INVENTION

Accordingly, one of the objects of the present invention is to provide a new and improved process for providing electrodeposition structures that have improved grain structure and reduced voids which may cause surface disruption.

Another object of the present invention is to provide an electrodeposition structure having greater ductility and a reduced propensity for surface disruption.

A further object of the present invention is to provide an annealing process that provides electrodepositon structures that are easier to repair.

The above objects and others are realized in accordance with the invention by a method in which an electrodeposition structure is exposed to heat and pressure above ambient to increase the ductility and change the grain structure of the electrodeposit. In one form of the invention, the electrodeposition structure is exposed to and held at a temperature between and including 48 and 99% of the melting temperature of the electrodeposit in an argon gas atmosphere. Upon cooling to ambient, improvements in ductility and grain structure of the electrodeposit were noted.

In another form of the present invention, an electrodeposition structure is heated to and held at a temperature between and including 48 and 99% of the melting temperature of the electrodeposit under argon gas at 15,000 psi. Upon returning the structure to ambient conditions, further improvements in ductility and grain structure were noted.

In another form of the invention, a method for annealing a structure formed by electrodeposition is disclosed, the method comprising first providing the electrodeposition structure, the electrodeposition structure comprising an electroformed mold, the electroformed mold having a nominal thickness between and including 0.5 mm to 8.0 mm and having a melting temperature; heating the electrodeposition structure to a temperature between ambient temperature and the melting temperature of the electrodeposition structure; isostatically pressurizing the electrodeposition structure to a pressure above ambient pressure; cooling the electrodeposition structure to ambient temperature; and depressurizing the electrodeposition structure to ambient pressure.

In yet another form of the invention, an electroformed mold is disclosed, the electroformed mold annealed at an annealing temperature above ambient temperature and an annealing pressure above ambient pressure wherein the electroformed mold comprises a material having an elongation measured at break before and after annealing, the elongation at break after annealing being greater than the elongation at break before annealing.

In yet another form of the invention, an electroformed mold is disclosed, the electroformed mold comprising a material having voids therein, at least a portion of the voids forming at least one protuberance on the surface of the electroformed mold when the mold is exposed to heat wherein the electroformed mold is annealed at an annealing temperature above ambient temperature and an annealing pressure above ambient pressure and wherein the number of voids forming protuberances on the surface of the electroformed mold is reduced after annealing of the electroformed mold as compared to before annealing of the electroformed mold.

BRIEF DESCRIPTION OF THE DRAWINGS

These and other objects, features and advantages of the invention will become apparent upon consideration of the description of the invention and the appended drawings in which.

The above and other objects, feature, and advantages of the present invention will be apparent in the following detailed description thereof when read in conjunction with the appended drawings wherein the same reference characters denote the same or similar parts throughout the several views.

DESCRIPTION OF THE INVENTION

As used herein, the term "electrodeposition" means the precipitation of a material at an electrode as the result of the passage of an electric current through a solution or suspension of the material, and encompasses both electroforming and electroplating.

As used in herein, the term "electrodeposition structure" means a structure produced by electrodeposition.

As used herein, the term "electroforming" means the precipitation of material on a mandrel as the result of the passage of an electric current through a solution or suspension of the material, with the mandrel to be separated from the form once the form is completed.

As used herein, the term "electroform" means a structure produced by electroforming.

Figure 1:
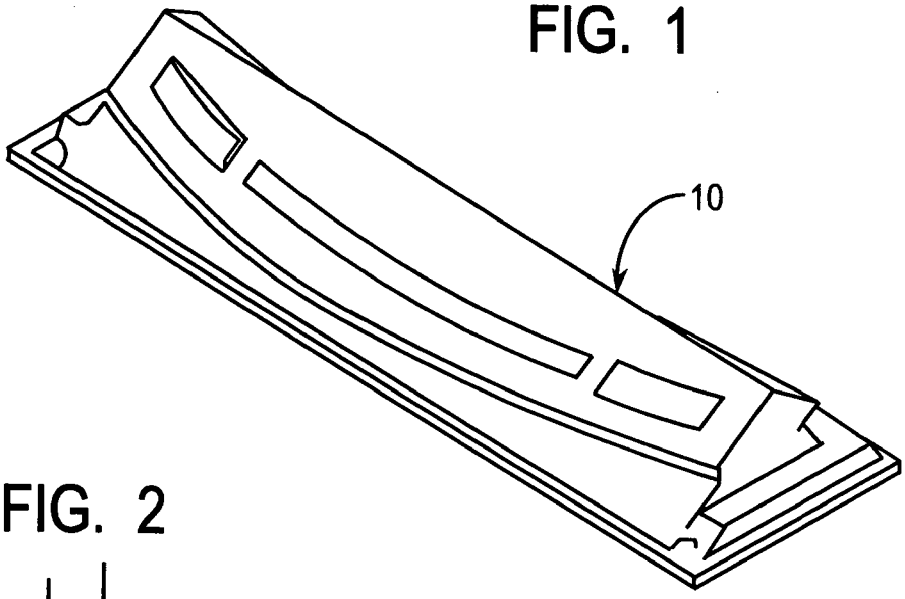
FIG. 1 is a representative perspective view of an exemplary electrodeposition structure which may be treated after formation in accordance with the present invention.

In accordance with the invention, an electrodeposition structure, and more specifically an electroform, is shown at 10 in FIG. 1. As shown, electroform 10 comprises a thin shell mold comprising nickel and having a nominal thickness in the range between and including 0.5 millimeters to 8.0 millimeters. More preferably, the electroform 10 has a thickness from 2.0 millimeters to 3.5 millimeters. Electroform 10 is preferably used to mold plastic, either thermoplastic or thermoset plastic, by slush, casting or rotational molding techniques as detailed, for example, in U.S. Pat. Nos. 4,389,177; 4,562,026; 4,610,620; 4,623,503; 4,755,333; 4,780,345; 4,890,995; 4,923,657; 4,925,151; 5,032,076; 5,037,678; 5,238,622; 5,290,499; 5,445,510; 5,824,738; and 5998,030 assigned to the assignee of the present invention and hereby incorporated by reference.

Figure 2:
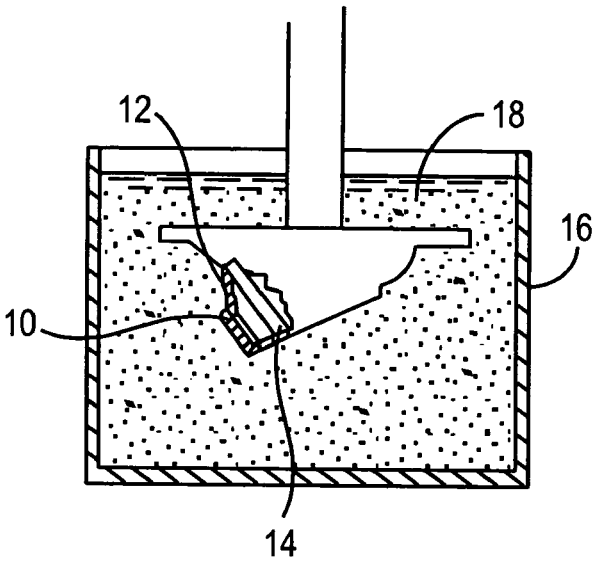
FIG. 2 is a representative cross-sectional view of the electrodeposition structure of FIG. 1 during formation thereof taken along line 2—2.

As shown in FIG. 2, electroform 10 is preferably formed via the electrodeposition, and more specifically via electroforming, of nickel onto the surface 12 on of a mandrel 14 in a tank 16 containing a solution 18 of nickel sulfamate. However, it should be understood that the present invention is not limited to the electrodeposition of nickel. Other metals can form electrodeposition structures via electrodeposition. Upon reaching the desired thickness, the electroform 10 and mandrel 14 are removed from the tank 16 and separated from one another.

Figure 3:
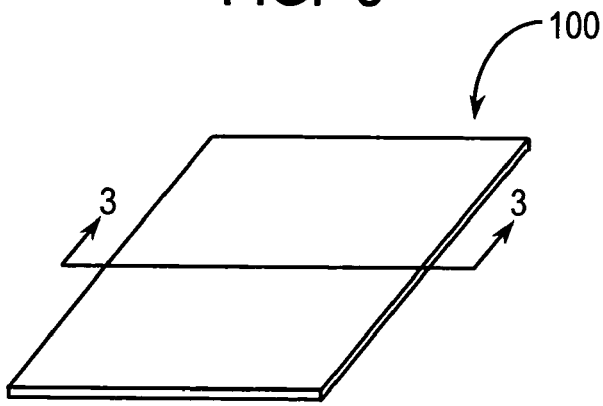
FIG. 3 is a representative perspective view of another exemplary electrodeposition structure which may be treated after formation in accordance with the present invention.

As shown in FIG. 3, the geometry of electroform 10 initially selected for annealing and subsequent testing comprises a flat plaque 100. Annealing of electroform 100 was then performed under two sets of conditions relative to a control sample upon which no annealing was performed. Measured response variables included tensile strength at 0.2% elongation, tensile strength at break, percent elongation at break and Rockwell B Hardness.

Figure 4:
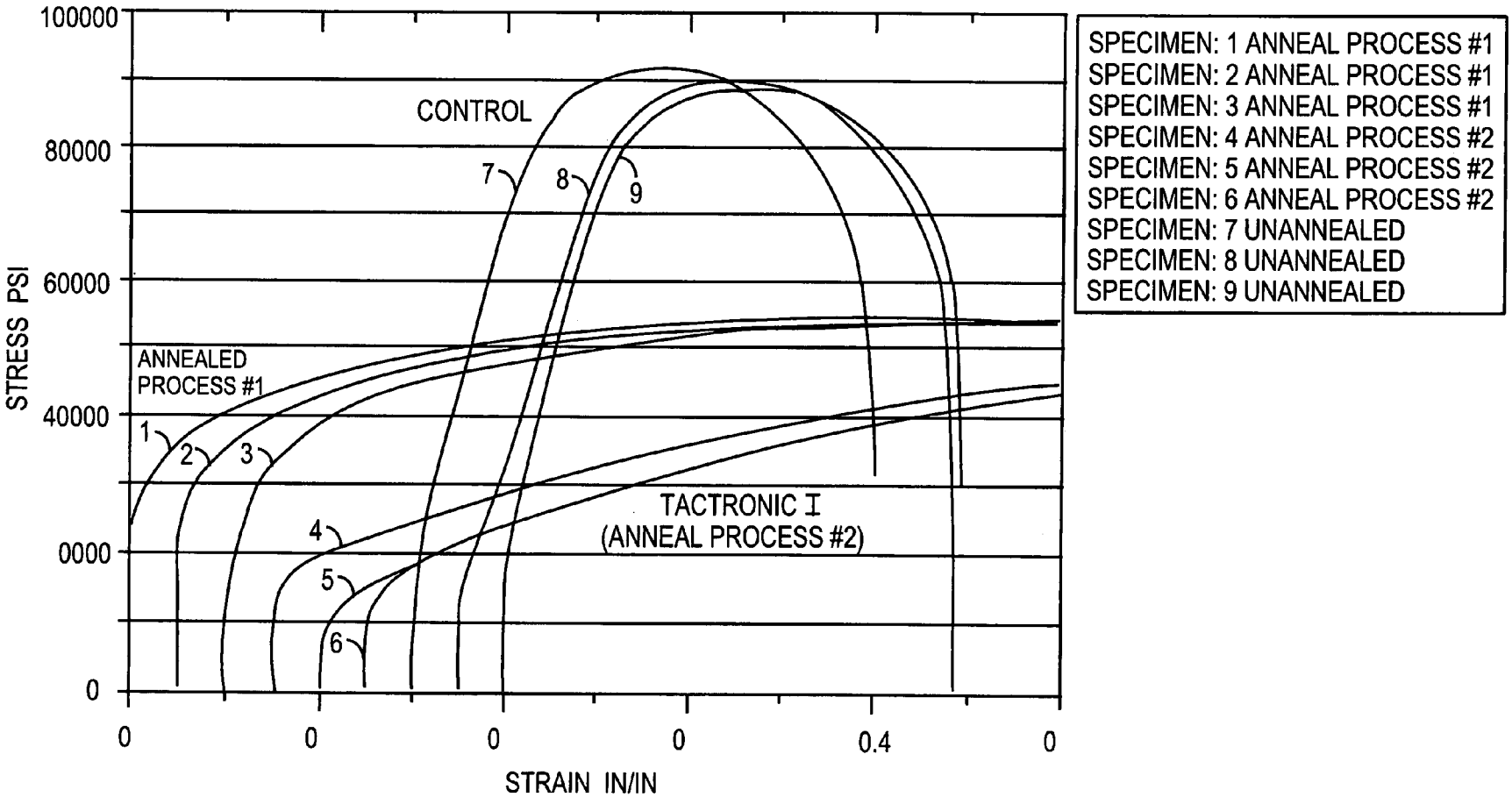
FIG. 4 is a stress-strain graph produced from test specimens taken from the electrodeposition structure of FIG. 3 and partially recorded in Table I.

Annealing Process No. 1 (as referenced in FIG. 4) involved heating 3 specimens of electroform 100 in a convection oven under argon gas at atmospheric pressure. The specimens were heated from ambient temperature (i.e. 18–23 degrees Celsius) to 950 degrees Fahrenheit (510 degrees Celsius) over a time period of 2 hours. Upon reaching 950 degrees Fahrenheit, the specimens of electroform 100 where then maintained at 950 degrees Fahrenheit for 4 hours. Thereafter, the specimens where cooled in the convection oven to ambient temperature over a time period of 18 hours.

Annealing Process No. 2 (as referenced in FIG. 4) involved heating as well as pressurizing 3 specimens of electroform 100 in a hot isostatic (i.e. uniform) pressure vessel under argon gas at 15,000 psi. (103.4 MPa). The specimens were heated from ambient conditions (i.e. 18–23 degrees Celsius at standard air pressure of 101.3 KPa) to 1850 degrees Fahrenheit over a time period of 2 hours. Upon reaching 1850 degrees Fahrenheit (1010 degrees Celsius), the specimens of electroform 100 were then maintained at 1850 degrees Fahrenheit for 4 hours. Thereafter, the specimens where then cooled for 4 hours in the pressure vessel and thereafter removed to cool to ambient temperature.

For electroform 100, the melting temperature of the nickel is 2250–2275 degrees Fahrenheit (1232–1246 degrees Celsius). Consequently, for Annealing Process No. 2, the electroform 100 was heated to 81–82% of the melt temperature of the electroform 100. However, heating may be provided in the range between and including 48% to 99% of the melt temperature, or any temperature sufficient to change the "tree ring" nickel laminar structure to a uniform grain structure. Depending on the temperature selected, it may become necessary to support the electroform 100 in the pressure vessel as to prevent distortion (i.e. sag) of the electroform under its own weight.

With respect to pressure for Annealing Process No. 2, as indicated above, isostatic pressure was maintained at 15,000 psi. However, isostatic pressure may be provided in the range between and including 5000 psi. to 15000 psi., or any pressure sufficient to defuse any entrained nitrogen trapped in the nickel from the plating process and to develop the necessary physical properties.

TABLE I

| Specimens | Tensile Strength at 0.2% Elong. | | Tensile Strength at Break | | % Elongation | Rockwell B |
|---|---|---|---|---|---|---|
| Control | KPSI | Mpa | KPSI | MPa | at Break | Hardness |
| 1 | 15.1 | 104.1 | 74.6 | 514.3 | 24.0% | — |
| 2 | 29.2 | 201.3 | 74.6 | 514.3 | 23.5% | — |
| 3 | 16.7 | 115.1 | 75.1 | 517.8 | 25.2% | — |
| Mean | 20.3 | 140.2 | 74.8 | 515.5 | 24.2% | 85.3 |
| St. Dev. | 7.7 | 53.2 | 0.3 | 2.0 | .9% | 1.2 |
| Annealing Process #1 | | | | | | |
| 1 | 14.9 | 102.7 | 54.2 | 373.7 | 52.0% | — |
| 2 | 10.9 | 75.2 | 54.6 | 376.5 | 48.4% | — |
| 3 | 16.3 | 112.4 | 55.5 | 382.7 | 48.5% | — |
| Mean | 14.0 | 96.3 | 54.8 | 377.6 | 49.6% | 58.0 |
| St. Dev. | 2.8 | 19.3 | .7 | 4.6 | 2.1% | 1.7 |
| Annealing Process #2 | | | | | | |
| 1 | 13.4 | 92.4 | 49.4 | 340.6 | 51.0% | — |
| 2 | 9.0 | 62.1 | 49.1 | 338.5 | 52.0% | — |
| 3 | 11.5 | 79.3 | 49.4 | 340.6 | 54.4% | — |
| Mean | 11.3 | 77.9 | 49.3 | 339.9 | 52.5% | 53.0 |
| St. Dev. | 2.2 | 15.2 | .2 | 1.2 | 1.8% | 1.0 |

KPSI = Pounds force per square inch × 1000.
Mpa = Megapascals

From Table I, it is shown that Annealing Process No. 1 increased the percent elongation at break, and hence the ductility, of the specimens from the electroform 100 while correspondingly decreasing the tensile strength at 0.2 percent elongation, tensile strength at break and Rockwell B Hardness.

Also from Table I, it is shown that the increased heat and pressure of Annealing Process No. 2 further increased the percent elongation at break of the specimens from the electroform 100 while correspondingly further decreasing the tensile strength at 0.2 percent elongation, tensile strength at break and Rockwell B Hardness.

Figure 5:
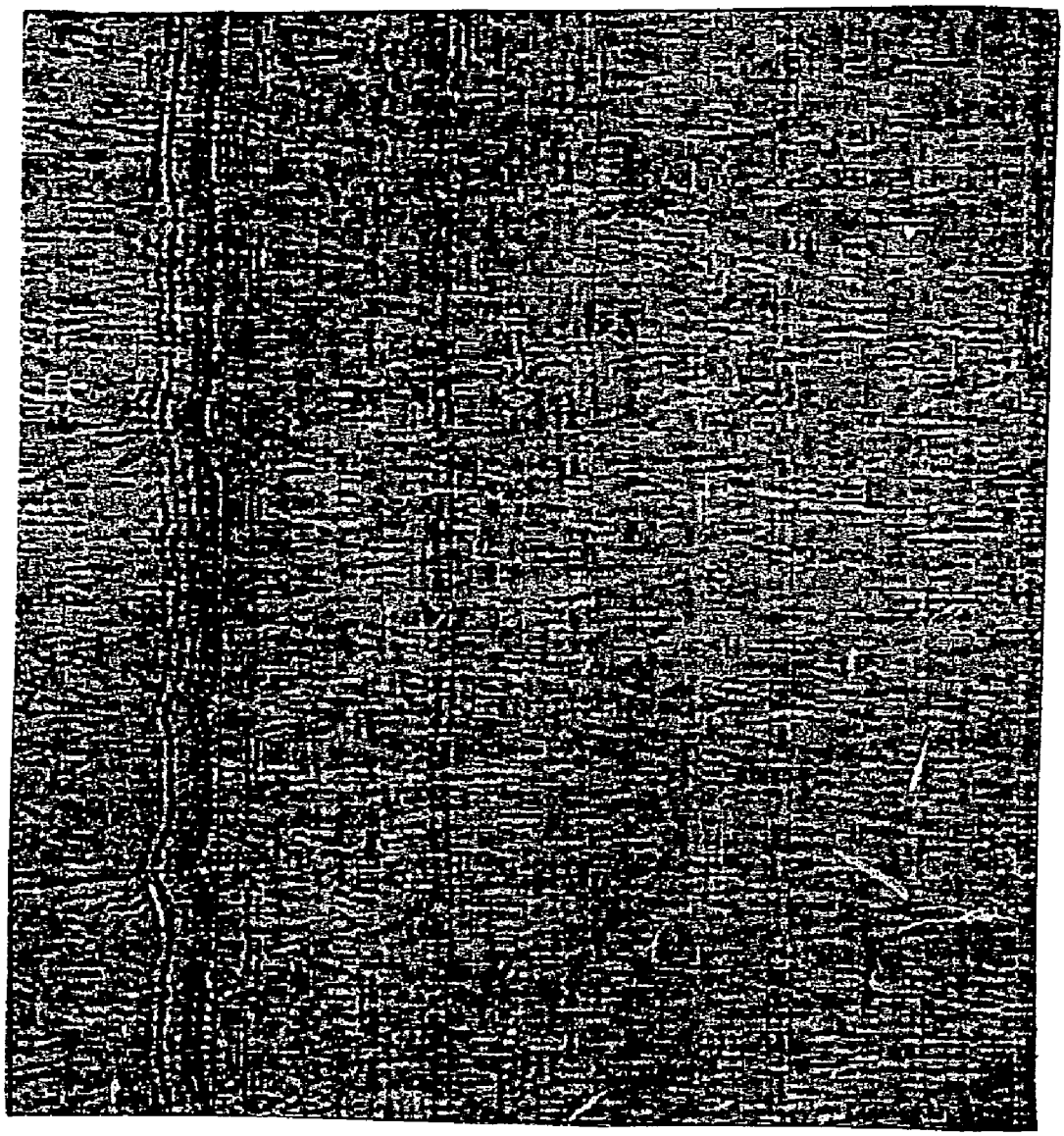
FIG. 5 is an enlarged cross-sectional view of the electrodeposition structure of FIG. 3 taken in the direction of line 3—3 and magnified 100× without any annealing after formation.
Figure 6:
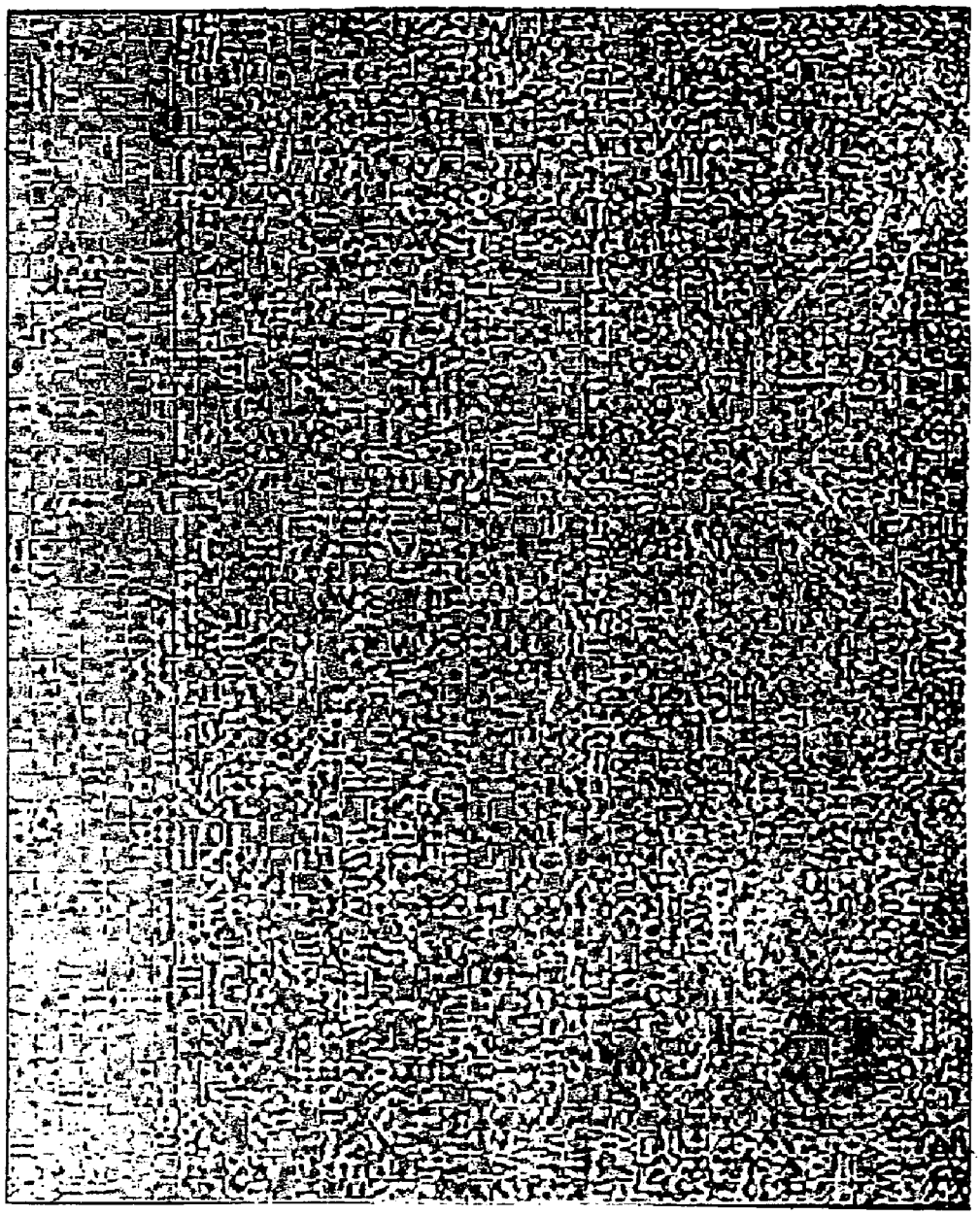
FIG. 6 is an enlarged cross-sectional view of the electrodeposition structure of FIG. 3 taken in the direction of line 3—3 and magnified 100× after treatment in accordance with Annealing Process No. 1 of the present invention.
Figure 7:
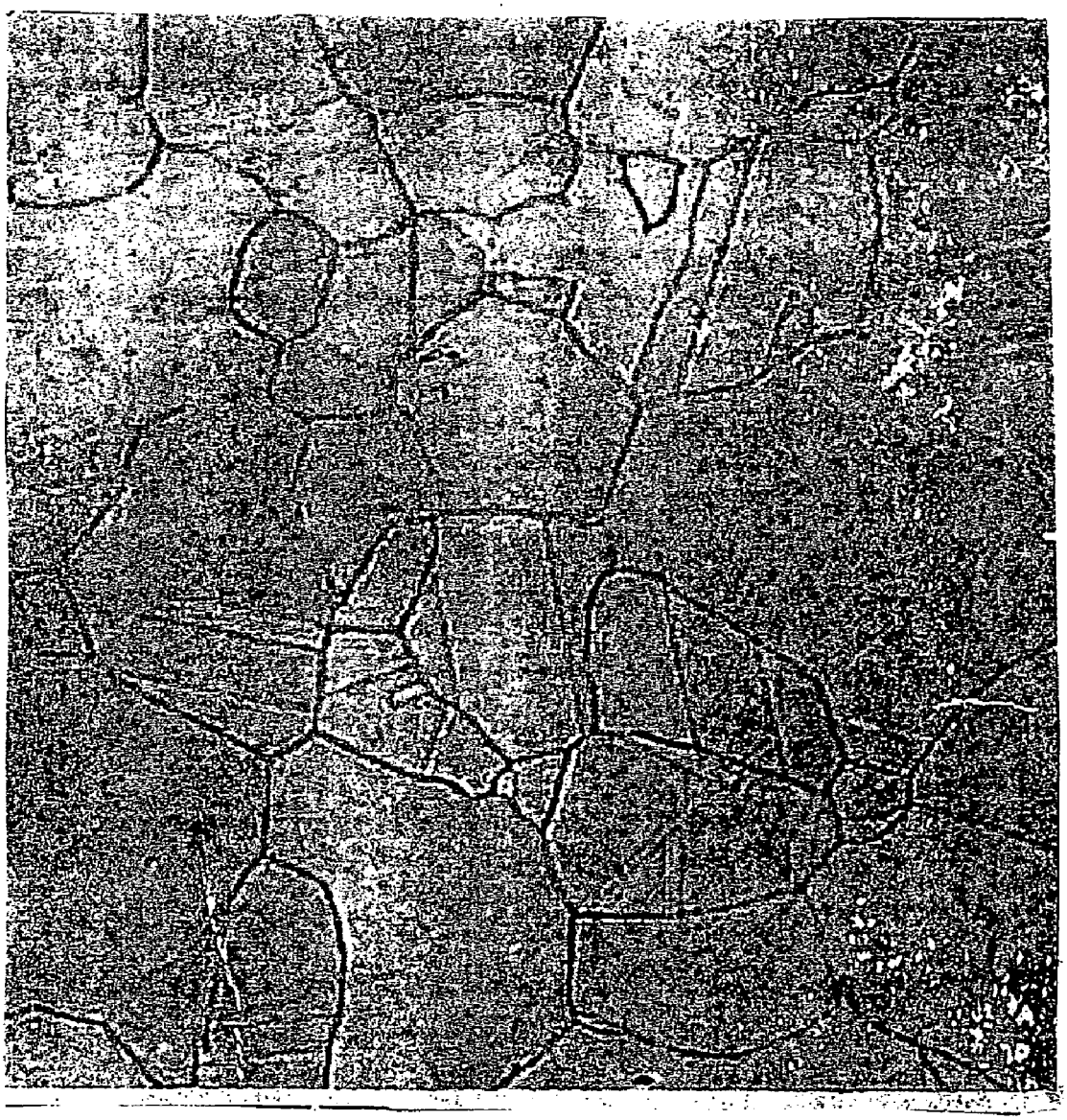
FIG. 7 is an enlarged cross-sectional view of the electrodeposition structure of FIG. 3 taken in the direction of line 3—3 and magnified 100× after treatment in accordance with Annealing Process No. 2 of the present invention.

In addition to the test data from Table I, FIGS. 5, 6 and 7 are photo-micrographs showing microscopic changes in the cross-sectional structure of electroform 100 in response to the different annealing processes. Turning to the figures, FIG. 5 is an enlarged cross-sectional view of the electroform 100 of FIG. 3 taken in the direction of line 3—3, magnified 100× and with 10% sulfuric acid etch without any annealing after formation. As shown, FIG. 5 clearly shows a structure of distinctly layered deposits throughout the thickness of the structure (somewhat analogous to that of age rings observed on the stump of a tree). As can be seen in FIG. 5, the individual layers are distorted (i.e. wavy) along the length of the cross-section. By comparison, as can be seen in FIG. 6, the distortion of the individual layers along the length of the cross-section is greatly reduced and the interface between the layers is substantially straight. Finally, as can be seen from FIG. 7, the layered disposition of the cross-section of FIG. 5 has given way or changed to a grain structure and the laminar structure in no longer visible.

Without being bound to a particular theory, when subjected to high temperature and pressure, a molecular realignment of the nickel occurs. This is very similar to the molecular structure of graphite changing to carbon when graphite is processed using similar temperature and pressure conditions. This is better known as carbon/carbon densification. The end result of processing the nickel under these conditions produces a nickel with greater than 3 times the elongation properties of conventional electroplated nickel. More nickel elongation means the nickel is "tougher" and this is thought to help reduce the nickel tools or molds from cracking.

In addition to test data and photomicrographs discussed above, the occurrence of voids that are formed in the electroform and that give rise to protuberances on the surface of the electroform was found to be reduced during subsequent heating to a processing temperature between 162 and 232 degrees Celsius when Annealing Process No. 2 was utilized as compared to when Annealing Process No. 1 or when no annealing process was utilized. Thus, in addition to increasing the percent elongation of electroform 100, Annealing Process No. 2 also decreases the occurrence of surface defects associated with voids within the structure of electroform 100 upon heating of the electroform 100.

In other embodiments, the electroform may comprise materials other than nickel. For example, other materials may include, but are not limited to other metals (e.g. copper, silver, gold). Also in other embodiments, the electroform may comprise one or more alloys. Also in other embodiments, the electroform may comprise multiple layers of different materials (e.g. copper and nickel).

The description and drawings illustratively set forth our presently preferred invention embodiments. We intend the description and drawings to describe these embodiments and not to limit the scope of the invention. Those skilled in the art will appreciate that still other modifications and variations of the present invention are possible in light of the above teaching while remaining within the scope of the following claims. Therefore, within the scope of the claims, one may practice the invention otherwise than as the description and drawings specifically show and describe.

We claim:

1. An electroformed mold comprising an electrodeposition structure, comprising an annealed metallic material having an elongation at break between about 48–55%, with a standard deviation of about 2.0%.

2. The electroformed mold of claim 1 wherein said metallic material has a tensile strength at break between about 340–383 MPa.

3. The electroformed mold of claim 1 wherein said metallic material has a cross-sectional structure comprising layers of material wherein said layers comprise a non-laminar grain structure.

* * * * *